US006177044B1

(12) United States Patent
Maschler et al.

(10) Patent No.: US 6,177,044 B1
(45) Date of Patent: Jan. 23, 2001

(54) BELL-SHAPED FURNACE

(75) Inventors: Frank Maschler, Duisburg; Walter Scheuermann, Bonn; Georg Velten, Essen, all of (DE)

(73) Assignee: Loi Thermprocess GmbH, Essen (DE)

( * ) Notice: Under 35 U.S.C. 154(b), the term of this patent shall be extended for 0 days.

(21) Appl. No.: 09/161,600

(22) Filed: Sep. 25, 1998

Related U.S. Application Data

(63) Continuation-in-part of application No. PCT/EP98/00246, filed on Jan. 17, 1998.

(30) Foreign Application Priority Data

Jan. 30, 1997 (DE) ..... 197 03 305
Jan. 29, 1998 (DE) ..... 198 03 259

(51) Int. Cl.[7] ..... C21D 1/06
(52) U.S. Cl. ..... 266/256; 266/263
(58) Field of Search ..... 266/256, 263, 266/262; 432/233

(56) References Cited

U.S. PATENT DOCUMENTS 5,230,617 * 7/1993 Klein et al. ..... 432/233
5,249,960 * 10/1993 Monroe ..... 432/77
5,290,017 * 3/1994 Hemsath et al. ..... 266/263

FOREIGN PATENT DOCUMENTS 32 33 815 * 3/1984 (DE) .
WO 98/33946 8/1998 (DE) .

* cited by examiner

*Primary Examiner*—Scott Kastler
(74) *Attorney, Agent, or Firm*—Fay, Sharpe, Fagan, Minnich & McKee, LLP

(57) ABSTRACT

A top hat furnace especially adapted for annealing steel sheet metal using a protective gas includes a protective top surrounding the batches of sheet steel metal. A cooling top is arranged above the protective top forming an intermediate space. The cooling top has a cover and a lid. The cover of the cooling top has a plurality of air nozzles so that cooling air impacts the protective top in the form of jets. At least one fan produces a flow of cooling air in the intermediate space. The distance between the air nozzles increases from the bottom of the cover towards it upper end. The distance between the nozzles is from four to twelve times greater than is the diameter of each nozzle. The cooling lid is also provided with a plurality of air nozzles. The distance between the nozzles in the cooling lid is from four to seven times greater than is the diameter of each of these nozzles.

17 Claims, 1 Drawing Sheet

BELL-SHAPED FURNACE

This application is a continuation-in-part of application serial No. PCT/EP 98/00246 which has an international filing date of Jan. 17, 1998, and is still pending.

FIELD OF THE INVENTION

The present invention relates to a bell-type furnace, particularly for annealing steel coils in a controlled atmosphere, with an inner cover which surrounds the steel coils, with a cooling cover which, forming an intermediate space, concentrically surrounds the inner cover and comprises a cooling-cover shell and a cooling-cover roof, the cooling-cover shell being provided with a plurality of air nozzles in such a way that cooling air in the form of jet streams impinges the inner cover, and with at least one fan for producing a cooling-air flow in the intermediate space.

Such bell-type furnaces are used particularly for the bright annealing of cold-rolled steel in the shape of coils in a controlled atmosphere.

During the annealing process, a heating cover is placed over the inner cover. After annealing, the heating cover is removed and replaced by a cooling cover.

BACKGROUND OF THE INVENTION

WO 95/20058 discloses a cooling cover with air nozzles arranged exclusively in the bottom third of its height. The coils are usually stacked on top of each other, being separated by convector plates. Volumetric flows through the convector ducts are significantly larger for the bottom coils in the stack than for the top coils. Consequently, coils lying at the bottom are at an advantage during cooling, while coils lying at the top are at a disadvantage. This is exacerbated by the fact that cooling occurs only in the bottom region. The cooling process cannot be ended until the temperature in the core of the top coil falls below the maximum temperature set for the end of cooling, which means that the cooling process takes fairly long.

THE INVENTION

It is therefore an object of the invention to enhance a bell-type furnace of the aforementioned kind so that cooling is improved and particularly the cooling time is reduced.

According to the present invention, this object is achieved in a bell-shaped furnace of the kind indicated above by the spacing between adjacent air nozzles increasing from the bottom up, said spacing being 4 to 20 times the nozzle diameter and, in addition, by providing the cooling-cover roof with a second plurality of air nozzles, the spacing between said second plurality of air nozzles being 4 to 8 times the nozzle diameter.

An arrangement wherein the spacing between the air nozzles of the cooling-cover shell continuously increases from the bottom up is particularly easy to design.

It is also possible to reduce the diameter of the nozzles from the bottom up. However, this solution calls for a more complicated design.

Convective heat transfer at the coil sides is determined by the volumetric flow of the circulated controlled atmosphere and the free flow cross-section of the annular gap between the inner cover and the coils. Since part of the controlled-atmosphere flow passes through the convector plates over the coil edges, the controlled-atmosphere speed determining the heat transfer decreases from the bottom up. Therefore, the invention proposed herein also reduces the cooling effect on the inner cover by increasing the spacing of the air nozzles in the cooling-cover shell from the bottom up.

At the topmost point of the inner cover, the controlled-atmosphere flow changes its direction, as a result of which the turbulence and hence the convective heat transfer to the cooling-cover roof is significantly larger than that between the inner cover and the cooling-cover shell in the region of the vertical annular gap between the coils and the inner cover. In addition, an appreciable exchange of radiated heat occurs between the inner cover and the top coil edge. The cooling-cover roof must therefore additionally be provided with a plurality of air nozzles to achieve intensive cooling there.

The advantage of the solution proposed herein is that the cooling of the coils is optimised, thus shortening the cooling process.

Another advantage is that the driving power of the fan can be relatively low. Consequently, the noise level is fairly low.

According to another feature of the invention, the bell-type furnace is characterised by the length of the air nozzles of the cooling-cover shell being 3 to 10 times the nozzle diameter.

This feature is based on the recognition that a very effective jet stream for cooling purposes is created if a fully developed tubular flow occurs in the air nozzles.

In an advantageous embodiment of the invention, the inlets of the air nozzles are rounded. This reduces pressure losses.

According to another feature of the invention, the speed of the cooling air in the air nozzles lies roughly between 10 and 40 m/s and preferably between 20 and 40 m/s.

It is advantageous if the speed of the cooling air in the air nozzles is at least 3 times the speed of the cooling-air flow in the intermediate space. The speed of the vertical flow in the intermediate space must be relatively low so that the cooling-air speed in all air nozzles in the cooling-cover shell is equally large as far as possible. The greatest possible width is therefore chosen for the intermediate space. The upper part of the cooling cover may in addition possess a greater external diameter than the bottom part in order to reduce the flow speed.

BRIEF DESCRIPTION OF THE DRAWINGS

The present invention is now explained in greater detail with the aid of a preferred embodiment illustrated in the accompanying drawing in which.

DETAILED DESCRIPTION

Figure 1:
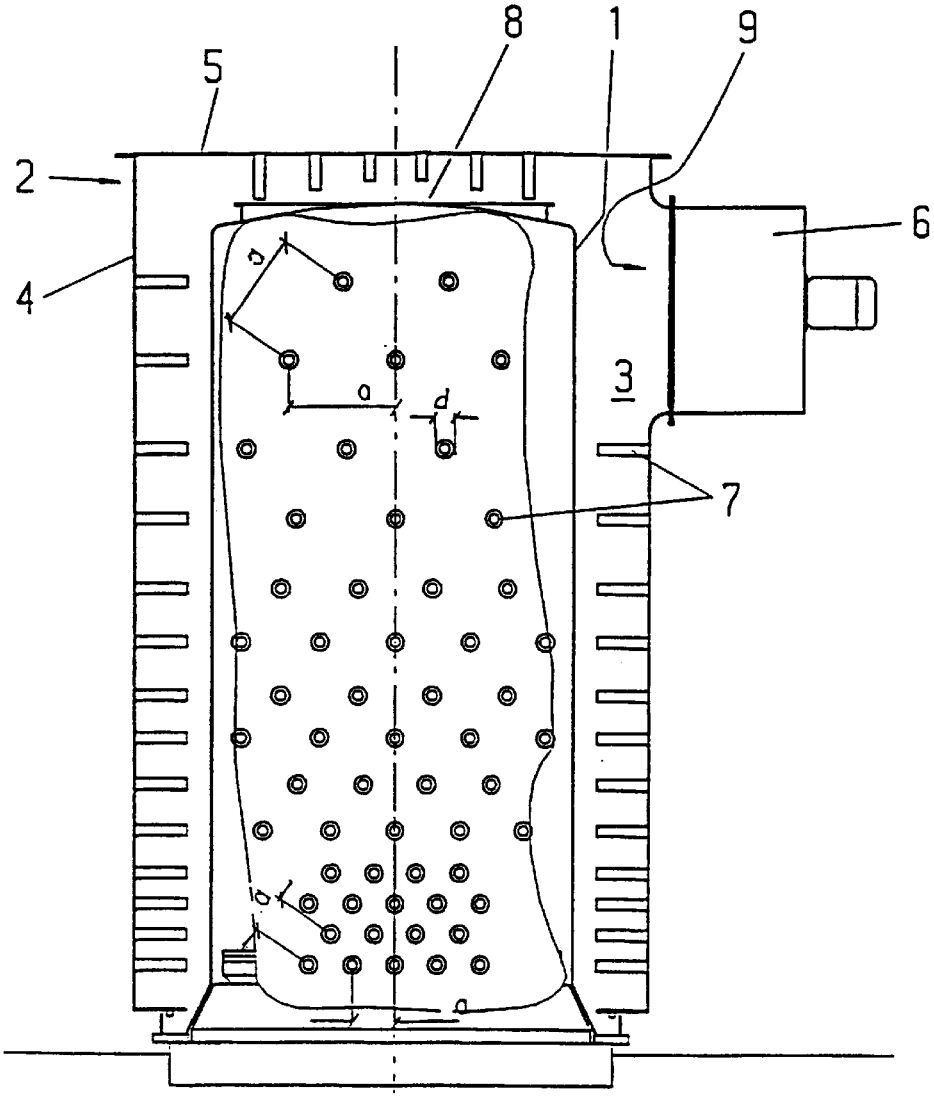
FIG. 1 is a schematic, longitudinally sectioned view of a bell-type furnace.

In the bell-type furnace shown in FIG. 1, steel coils not shown in the drawing are annealed in a controlled atmosphere under inner cover 1. The heating cover placed over the inner cover is likewise not shown. When the annealing process has finished, the heating cover is replaced by cooling cover 2, which surrounds inner cover 1 concentrically, forming intermediate space 3.

Cooling cover 2 possesses a substantially cylindrical cooling-cover shell 4 and a cooling-cover roof 5. A fan 6 of axial or radial design is located laterally of cooling-cover shell 4.

Cooling-cover shell 4 is provided with a first plurality of air nozzles 7 arranged in a spaced relationship over substantially the entire height of said shell. A bottom row of nozzles is 300–600 mm above the inner-cover flange. Spacings a from the middle of air nozzle 7 to the middle of adjacent air nozzle 7 are varied from the bottom up. More particularly, said spacings are continuously increased from the bottom towards said cooling-cover roof 5. Said spacings a may be varied in a range of 4 to 20 times the nozzle diameter d of said first plurality of air nozzles 7. Said nozzle diameter d is in the range of 40–100 mm.

Figure 2:
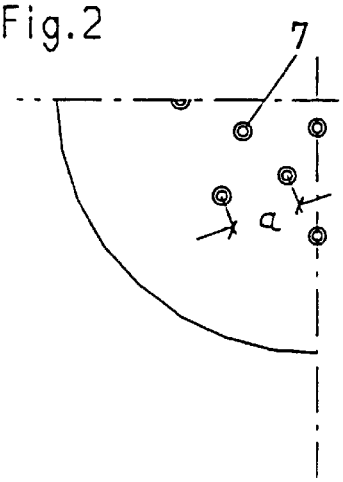
FIG. 2 is a quarter of a top view of the bell-type furnace shown in FIG. 1.

FIG. 2 shows that cooling-cover roof 5 is additionally provided with a plurality of air nozzles 7, hereinafter called "second plurality of air nozzles". Said second plurality of air nozzles having a spacing a in a range between 4 and 8 times the nozzle diameter d. This spacing in the indicated range has the beneficial result that the top part of the inner cover 8, which is shaped as a dished head, is intensively cooled.

Figure 3:
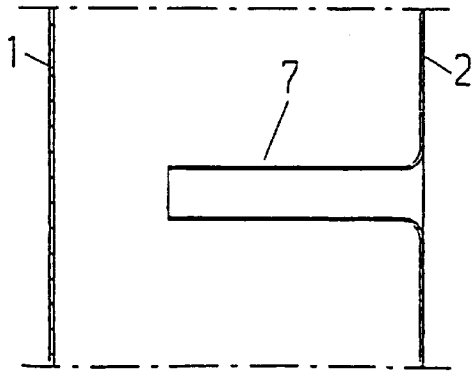
FIG. 3 is an enlarged view of a detail of an air nozzle.

Said first plurality of air nozzles 7 radially protrude inwards from cylindrical cooling shell surface 4. The length of cooling nozzles 7 is about 3 to 10 times the nozzle diameter. FIG. 3 shows that the air nozzles have rounded inlets which are substantially flush with the outside of the cooling cover shell and are formed so as to avoid pressure losses in the inlet area.

The speed of the fan and the dimensions and numbers of the air nozzles are selected so that the cooling air passing said air nozzles has a speed in the range between 10 and 40 m/s and preferably between 20 and 40 m/s.

Fan 6 draws in cooling air via intermediate space 3 and takes the heated air up and out. Inlet 9 of fan 6 in intermediate space 3 between cooling cover 2 and inner cover 1 is rounded. The speed of the vertical flow from the bottom up in intermediate space 3 is relatively low compared with the speed of cooling air in the air nozzles, which is at least 3 times the speed of the cooling-air flow in intermediate space 3.

The jet stream from the air nozzles supplying cold drawn-in ambient air is highly effective for cooling purposes, the cooling effect decreasing from the bottom up. The flow of air from bottom up in the intermediate space barely contributes to the cooling process but merely serves to lead the heated air up and out.

Modified embodiments of the invention are easily possible. For example, the top portion of cooling cover 2 may possess a greater external diameter than the bottom portion.

What is claimed is:

1. A bell-shaped furnace for the heat treatment of metal coils, said furnace comprising:

an inner cover which surrounds the steel coils, a cooling-cover which surrounds the inner cover in a substantially concentrical and spaced relationship thereto to form an intermediate space in between, said cooling cover including a circumferential cooling cover shell and a cooling cover roof, at least one fan means for producing a cooling air flow, conduit means coupled to said fan means and said intermediate space, said conduit means comprising a) a first plurality of air nozzles mounted to said cooling cover shell and arranged in a mutually spaced relationship, said first plurality of air nozzles each having a first nozzle diameter and being configured so that cooling air jet streams are formed in said nozzles, passed into said intermediate space and directed to impinge on said inner cover, adjacent air nozzles disposed in said shell being increasingly spaced from the bottom up for enhancing a cooling of the coils, the spacings of adjacent nozzles of said first plurality of air nozzles varying within a range of 4 to 20 times the nozzle diameter of said first plurality of air nozzles; and b) a second plurality of air nozzles mounted to said cooling cover roof in a mutually spaced relationship, said second plurality of air nozzles each having a second nozzle diameter, passing cooling air produced by said fan means into said intermediate space and being configured so that cooling air jet streams are formed in said nozzles and directed to impinge on said inner cover, adjacent nozzles of said second plurality of air nozzles having spacings in a second range that is 4 to 8 times the nozzle diameter of said second plurality of air nozzles.

2. The bell-shaped furnace according to claim 1, wherein the nozzle diameters of the air nozzles of said first plurality and of said second plurality are equal.

3. The bell-shaped furnace according to claim 2 wherein the spacings between adjacent nozzles of said first plurality of air nozzles are continuously increased from the bottom up.

4. The bell-shaped furnace according to claim 1 wherein the air nozzles of said first plurality of nozzles have a length that is in the range of 3 to 10 times the nozzle diameter.

5. The bell-shaped furnace according to claim 1, wherein the air nozzle of said first and second pluralities of air nozzles each have a rounded inlet.

6. The bell-shaped furnace according to claim 1 further comprising a substantially ring shaped bottom portion of said cooling cover and a substantially ring shaped upper portion of said cooling cover, said upper portion of said cooling cover having an external diameter that is larger than the external diameter of the bottom portion.

7. A bell-shaped furnace for a heat treatment of metal coils, said furnace comprising:

an inner cover which surrounds a plurality of associated coils;

a cooling cover which surrounds said inner cover in a substantially concentric and spaced relationship to form an intermediate space between said inner cover and said cooling cover;

a fan communicating with said intermediate space for producing a cooling air flow;

a first plurality of air nozzles located on said cooling cover, the nozzles of said first plurality of air nozzles being spaced from each other and being configured so that cooling air jet streams are formed in said nozzles, said air jet streams passing into said intermediate space and impinging on said inner cover, wherein said air nozzles are disposed in said cooling cover in a manner such that said air nozzles are located closer to each other adjacent a bottom portion of said cooling cover and are located farther from each other adjacent a top portion of said cooling cover thereby enhancing cooling of the coils.

8. The bell-shaped furnace of claim 7 wherein adjacent air nozzles of said first plurality of air nozzles are spaced from each other by a distance within a range of approximately 4 to 20 times a nozzle diameter of said first plurality of air nozzles.

9. The bell-shaped furnace of claim 7 wherein said cooling cover comprises a cover shell and a cover roof.

10. The bell-shaped furnace of claim 9 wherein said first plurality of air nozzles are located on said cover shell and further comprising a second plurality of air nozzles located on said cooling cover roof in a mutually spaced relationship, wherein said cooling air jet streams formed in said second plurality of nozzles are directed to impinge on said inner cover.

11. The bell-shaped furnace of claim 10 wherein adjacent nozzles of said second plurality of air nozzles have a spacing that is approximately 4 to 8 times a nozzle diameter of said second plurality of air nozzles.

12. The bell-shaped furnace according to claim 11 wherein a nozzle diameter of said air nozzles of said first plurality of air nozzles is equal to a nozzle diameter of said air nozzles of said second plurality of air nozzles.

13. The bell-shaped furnace according to claim 7 wherein the spacings between the adjacent nozzles of said first plurality of air nozzles are continuously increased from a bottom portion of said cooling cover to a top portion thereof.

14. The bell-shaped furnace according to claim 7 wherein the air nozzles of said first plurality of nozzles have a length that is in the range of approximately 3 to 10 times a nozzle diameter of said first plurality of air nozzles.

15. The bell-shaped furnace according to claim 7 wherein the air nozzles of said first plurality of air nozzles each have a rounded inlet.

16. The bell-shaped furnace according to claim 7 further comprising a substantially ring-shaped lower portion of said cooling cover and a substantially ring-shaped upper portion of said cooling cover, said upper portion of said cooling cover having an external diameter which is larger than an external diameter of said lower portion.

17. A cooling cover for a bell-shaped furnace comprising:

a circumferential cooling cover shell having a first axial end and a second axial end;

a cooling cover roof connected to the first axial end of the cooling cover shell;

a first plurality of air nozzles extending radially inward from said cooling cover shell and arranged in a mutually spaced relationship, adjacent air nozzles being increasingly spaced from the second axial end toward the first axial end; and a second plurality of air nozzles extending downward from said cooling cover roof in a mutually spaced relationship.

* * * * *